United States Patent [19]

Watarai et al.

[11] Patent Number: 4,996,567

[45] Date of Patent: Feb. 26, 1991

[54] METHOD OF CONTROLLING FUSER UNIT OF IMAGE FORMING APPARATUS

[75] Inventors: Shinichi Watarai, Yokohama; Megumi Yasuda, Kawasaki; Yoji Hoki, Tokyo; Makoto Inoue, Ono, all of Japan

[73] Assignee: Fujitsu Limited, Kawasaki, Japan

[21] Appl. No.: 349,312

[22] Filed: May 9, 1989

[30] Foreign Application Priority Data

May 17, 1988 [JP] Japan ..... 63-119878

[51] Int. Cl.[5] ..... G03G 15/20

[52] U.S. Cl. ..... 355/290; 219/216; 355/208

[58] Field of Search ..... 355/289, 290, 285, 208; 219/216, 469

[56] References Cited

U.S. PATENT DOCUMENTS

| | | | |
|---|---|---|---|
| 4,385,826 | 5/1983 | Itoh | 219/216 X |
| 4,415,800 | 11/1983 | Dodge et al. | 219/216 X |
| 4,480,908 | 11/1985 | Anzai et al. | 355/285 |
| 4,609,278 | 9/1986 | Taniguchi | 219/216 X |
| 4,737,818 | 4/1988 | Tanaka et al. | 219/216 X |

FOREIGN PATENT DOCUMENTS

| | | | |
|---|---|---|---|
| 60-239787 | 11/1928 | Japan . | |
| 60-207173 | 10/1985 | Japan . | |
| 0277986 | 12/1986 | Japan | 355/289 |

*Primary Examiner*—A. T. Grimley
*Assistant Examiner*—Robert Beatty
*Attorney, Agent, or Firm*—Staas & Halsey

[57] ABSTRACT

A method of controlling a fuser unit of an image-forming apparatus such as a laser printer, in a warming-up stage, so that excess mechanical and electrostatic stresses are not imposed on the process elements. The method includes the steps of: starting the energization of a heater of a heat roller substantially at the same time as the commencement of an initialization process of mechanical and electrostatic conditions of the apparatus while rotating the heat roller and a backup roller together; stopping the rotation of the rollers after the initialization process has been completed; monitoring a surface temperature of the heat roller for a first predetermined period after the completion of the initialization; and if the surface temperature has reached a set value within the first predetermined period, determining that the fuser unit is ready for operation, and conversely, if the set value has not reached within the first predetermined period, carrying out an additional warming-up process of rotating the heat roller and the backup roller again until the set value is reached, unless a second predetermined period has expired subsequent to the expiration of the first predetermined period.

12 Claims, 9 Drawing Sheets

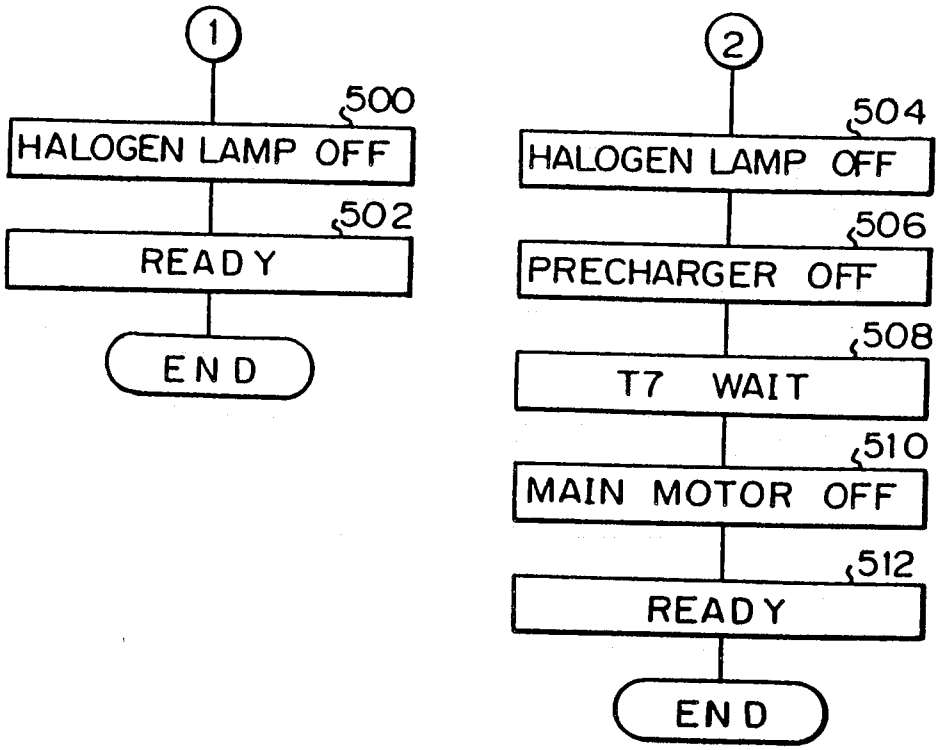
Fig. 5(A)
Fig. 5(B)
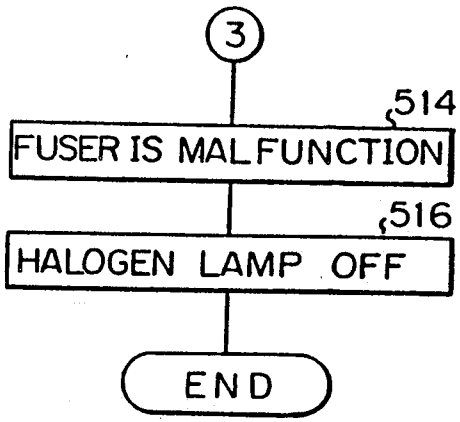
Fig. 5(C)

METHOD OF CONTROLLING FUSER UNIT OF IMAGE FORMING APPARATUS

BACKGROUND OF THE INVENTION

1. Field of the Invention

The present invention relates to a method of controlling a fuser unit of an image-forming apparatus, especially at the warm-up stage of the apparatus.

2. Description of the Related Arts

In an electronics image-forming apparatus, such as a copier, printer, or facsimile machine, a toner image formed on a photoconductive drum is transferred to a sheet medium and fixed thereon by a fuser unit.

In FIGS. 7(A) and 7(B), which illustrates a principle of the toner fixing process, a fuser unit 14 comprises a pair of a heat roller 10 and a backup roller 12. The heat roller 10 is made of a heat-conductive material, such as an aluminum tube coated with a layer of a heat-durable resin and is fitted with an internal built-in heater. The backup roller 12 is made of an elastomeric material, such as a silicone rubber, and is pressed against the surface of the heat roller 10 to be frictionally driven by the rotation of the heat roller 10, which is in turn driven by a main motor of the apparatus. Accordingly, the rollers 10 and 12 rotate together during the printing process and nip a sheet medium 16 therebetween to heat-fix a toner image 18 carried on the sheet medium 16.

To achieve a favorable printing quality, it is important to initialize the mechanical and electrostatic conditions of the machine before starting the printing process. In the initialization, a single main motor of the apparatus is rotated to thereby drive all rotating elements of the machine including the heat roller 10. At the same time, the built-in heater of the heat roller 10 is energized to elevate the temperature thereof.

The initialization lasts for only a short period, because it imposes an unfavorable stress on process elements such as a photoconductive drum or a developer, and thus shortens the life span thereof. Therefore, the main motor is stopped immediately after the initialization period is completed, and thus all of the rotating elements in the apparatus become stationary. The built-in heater of the heat roller 10, however, is still energized while a surface temperature of the roller 10 is monitored by a sensor, and when the monitored temperature reaches a predetermined value, it is determined that the warm-up stage is completed and the apparatus is ready to start the printing process.

Nevertheless, a problem arises in the abovementioned steps in that the heater of the heat roller 10 is energized while the roller 10 is stationary after the initialization has been completed. As shown in FIG. 7(A), a temperature distribution of the heat roller 10 and the backup roller 12 in this case is such that a whole periphery of the heat roller 10 including the topmost point HT 10 and the bottommost point HB 10 is equally heated by the built-in heater, whereas in the backup roller 12, although a region in the vicinity of the topmost point HT 12 is heated to substantially the same level as the heat roller 10, by heat conduction from the heat roller 10, the lower region of the backup roller 12 remains at a lower temperature because of a relatively poor heat conductivity of the silicone rubber forming the same, whereby a temperature gradient is formed through the backup roller 12 from the topmost point HT 12 to the bottommost point HB 12. Accordingly, if the printing process is started immediately after the surface temperature of the heat roller 10 has reached the predetermined value, the heat stored in the body of the heat roller 10 is transferred to the lower temperature region of the backup roller 12 in the vicinity of the point HB 12, every time the point HB 12 is in contact with the heat roller 10, as shown in FIG. 7(B), and this causes the surface temperature of the heat roller 10 to drop below the predetermined lower limit value for fixing the toner 18 on the sheet medium 16. This phenomenon is particularly serious when the apparatus is non-operative for a long time in low ambient temperature conditions. The temperature transition of each of the rollers 10 and 12 during the initialization and warm-up stage is illustrated in FIG. 8, in which the surface temperature of the heat roller 10 becomes lower than the lower limit for a period t, even after the predetermined temperature has been once obtained.

To solve the above problem, as shown in FIG. 9, Japanese Examined Patent Publication (Kokoku) No. 61-31462 (corresponding to U.S. Patent No. 4,385,826) proposed that the energization of a heater in a heat roller be started while the roller is stationary (step 900), this energization be continued for a predetermined period (step 902), and then the main motor driven to rotate the heat roller together with a backup roller until the surfaces of both rollers are uniformly and sufficiently heated (904).

According to this method, however, the mechanical-/electrostatic stresses stored in the process elements are larger than in the usual case because the process elements must be additionally driven together with the heat roller for a longer period. Further, even though an ambient temperature is not so low or the apparatus is restarted immediately after a temporary machine stop, the energization of the heater is forcibly carried out for a predetermined period as routine, which delays the commencement of the printing operation and lowers the machine efficiency.

SUMMARY OF THE INVENTION

Therefore, an object of the present invention is to eliminate the above drawbacks of the prior art and to provide a method of controlling a fuser unit of an image-forming apparatus, which improves printing quality even when the apparatus is warmed-up in a low ambient temperature conditions while an electric power necessary for energizing a heat roller is reduced and a stress imposed on the process elements is minimized.

This object is achieved by a method of controlling a fuser unit of an image-forming apparatus in a warming-up stage, which unit comprises a heat roller and a backup roller pressed against the heat roller, and between which a sheet medium is nipped so that a toner image carried on the sheet medium is fixed, characterized in that the method comprises the steps of: starting the energization of a heater of the heat roller substantially at the same time as the commencement of an initialization of mechanical and electrostatic conditions of the machine, while rotating the heat roller and the backup roller together; stopping the rotation of the rollers after the initialization is completed; monitoring a surface temperature of the heat roller for a first predetermined period after the completion of the initialization process; and if on one hand the surface temperature is elevated to a set value within the first predetermined period, determining that the fuser unit is ready for operation, or if on the other hand the set value is not obtained, rotating the heat roller and the backup roller again until the set value has been obtained, unless a second predetermined period has expired subsequent to the expiration of the first predetermined period.

According to the present invention, once the initialization has been completed, the rotation of the heat roller and the backup roller for warming-up is restarted only when the surface temperature of the heat roller can not be elevated to the set value within the first predetermined period, and this additional rotation of the heat roller and the backup roller is immediately stopped after the set value has been reached. This is based on the phenomenon that, when an apparatus is warmed-up in a usual ambient temperature condition or restarted after a short temporary machine stop, for example, to clear a paper jam, the roller temperature is high enough to obtain the set value within the first predetermined period, and thus an additional rotation of the heat roller is rarely necessary, for example, only when the apparatus is maintained under cold ambient conditions for a long time. Accordingly, in most cases, the apparatus can be warmed-up without the excess stress caused by an additional initialization process.

BRIEF DESCRIPTION OF THE DRAWINGS

These and other objects and advantages of the present invention will be more apparent from the following description with reference to the drawings illustrating the preferred embodiments of the present invention, wherein:

FIGS. 4 and 5, respectively, are together a flow chart for explaining an operation of one preferred embodiment of the present invention;

DESCRIPTION OF THE PREFERRED EMBODIMENTS

Figure 1:
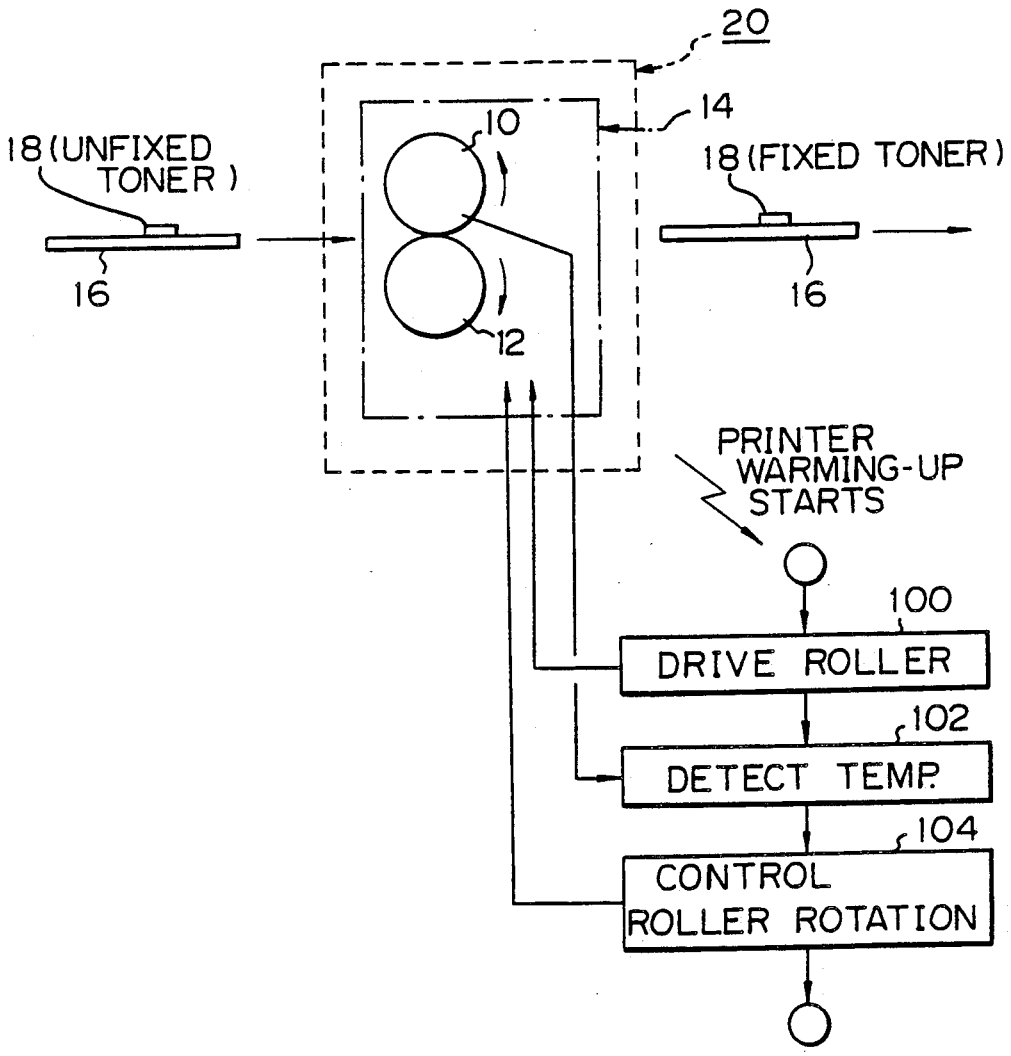
FIG. 1 is a diagram illustrating a principle of a control system for a fuser unit according to the present invention.

The principle of a method of controlling a fuser unit according to the present invention will be explained with reference to FIG. 1, wherein a fuser unit 14 of a printer 20 comprises a heat roller 10 and a backup roller 12, between which a toner 18 carried on a sheet medium 16 is subjected to pressure and heat and is fixed on the sheet medium 16.

Upon commencement of the operation of the printer 20, a built-in heater of the heat roller 10 is energized and the heat roller 10 is driven to rotate together with the backup roller 12. The rotation of the rollers 10 and 12 is stopped when the initialization of the machine conditions is completed (step 100).

A surface temperature of the heat roller is constantly monitored by a sensor (step 102), and if the surface temperature of the heat roller 10 reaches a set value within a first predetermined period after the rotation of the rollers 10 and 12 has been stopped, it is determined that the fuser unit is ready for operation. Conversely, if the surface temperature has not reached the set value within the first predetermined period, the rotation of the rollers 10 and 12 is repeated, and when the surface temperature of the heat roller 10 has reached the set value within a second predetermined period, the rotation of the rollers 10 and 12 is stopped.

If, however, the surface temperature of the heat roller 10 cannot reach the set value within the second predetermined period, it is determined that the fuser unit is abnormal and the rotation of the rollers is forcibly stopped to avoid an imposing of excess stress on the process elements in the apparatus (step 104).

Figure 2:
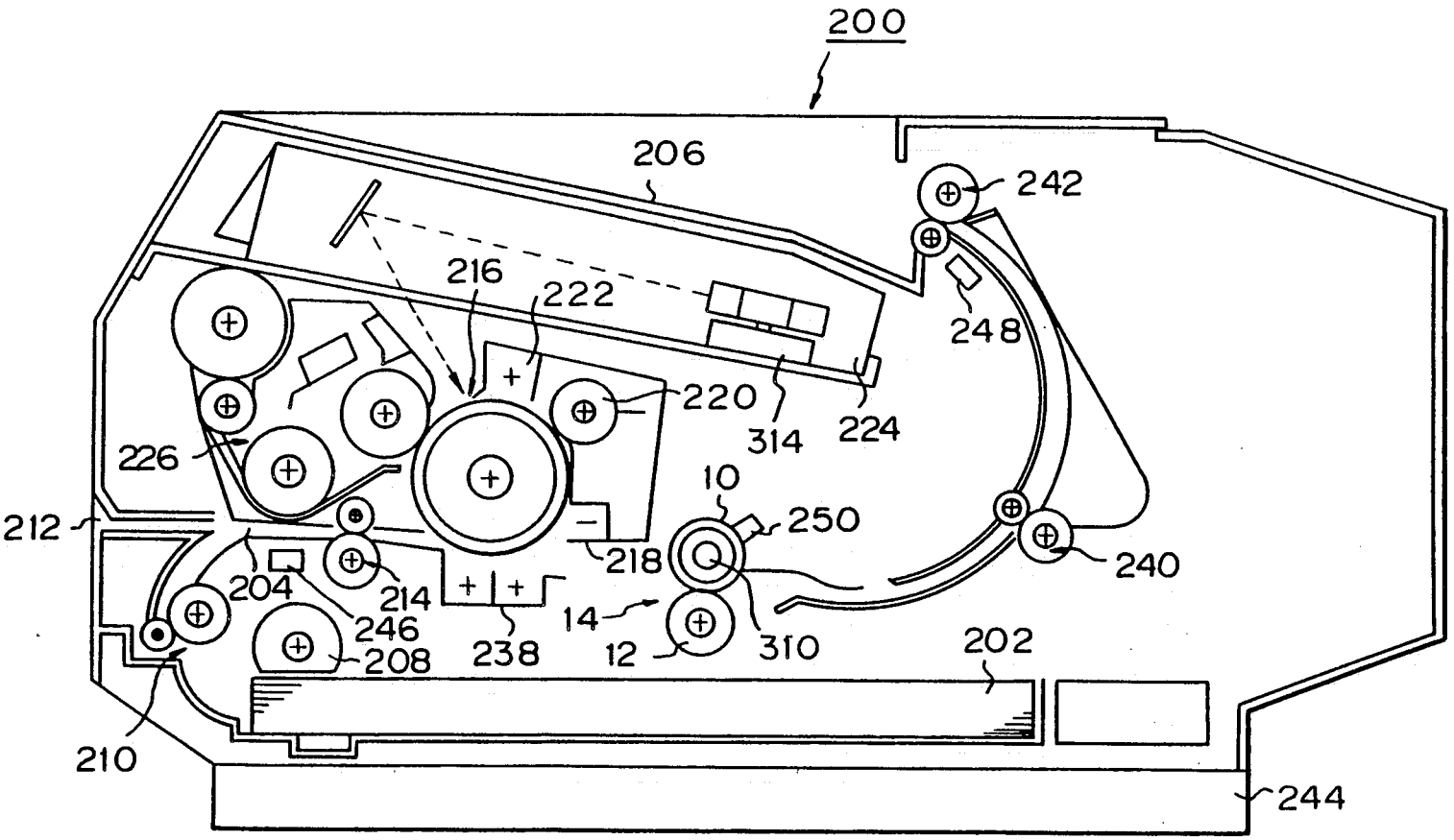
FIG. 2 is a side elevational view of a laser printer.

FIG. 2 illustrates a representative internal structure of a laser printer 200 to which the present invention is applied, wherein cut sheets 202 are stacked in a cassette and conveyed one by one along an S-shaped path 204 to an output tray 206 provided in the upper area of the printer 200.

The cut sheets 202 are lifted out by a pick-up roller 208 and transferred to the path 204 by a supply roller 210. Alternatively, the cut sheets 202 may be input to the interior of the printer 200 through a sheet insertion slit 212 formed on the left-hand side of the printer 200 as viewed in FIG. 2, and transferred to the path 204 through a supply roller 214. The cut sheets 202 are moved along the path 204 to pass under a photoconductive drum 216.

The surface of the photoconductive drum 216 is first discharged by a discharger 218 and cleaned by a cleaner 220, and then charged by a precharger 222. A laser beam is radiated from an optical-unit 224 and transversely scanned over the surface of the drum 216, to form an electrostatic latent image thereof, and the latent image is developed as a toner image by a developer unit 226.

The toner image formed on the surface of the photoconductive drum 216 is transferred to the cut sheets 202 by a transfer-charger 238. Then the cut sheets 202 are fed to a fuser unit 14 comprising a heat roller 10 and a backup roller 12, where the toner image is fixed on the cut sheets 202, and the cut sheets are then discharged to the output tray 206 through two pairs of output rollers 240 and 242.

A control unit 244 is provided in the lowermost area of the printer 200, and sheet-detecting sensors 246 and 248 are provided and cooperate with the control unit 244. Also, a sensor 250 is provided in the vicinity of the heat roller 10 for monitoring a surface temperature thereof.

Figure 3:
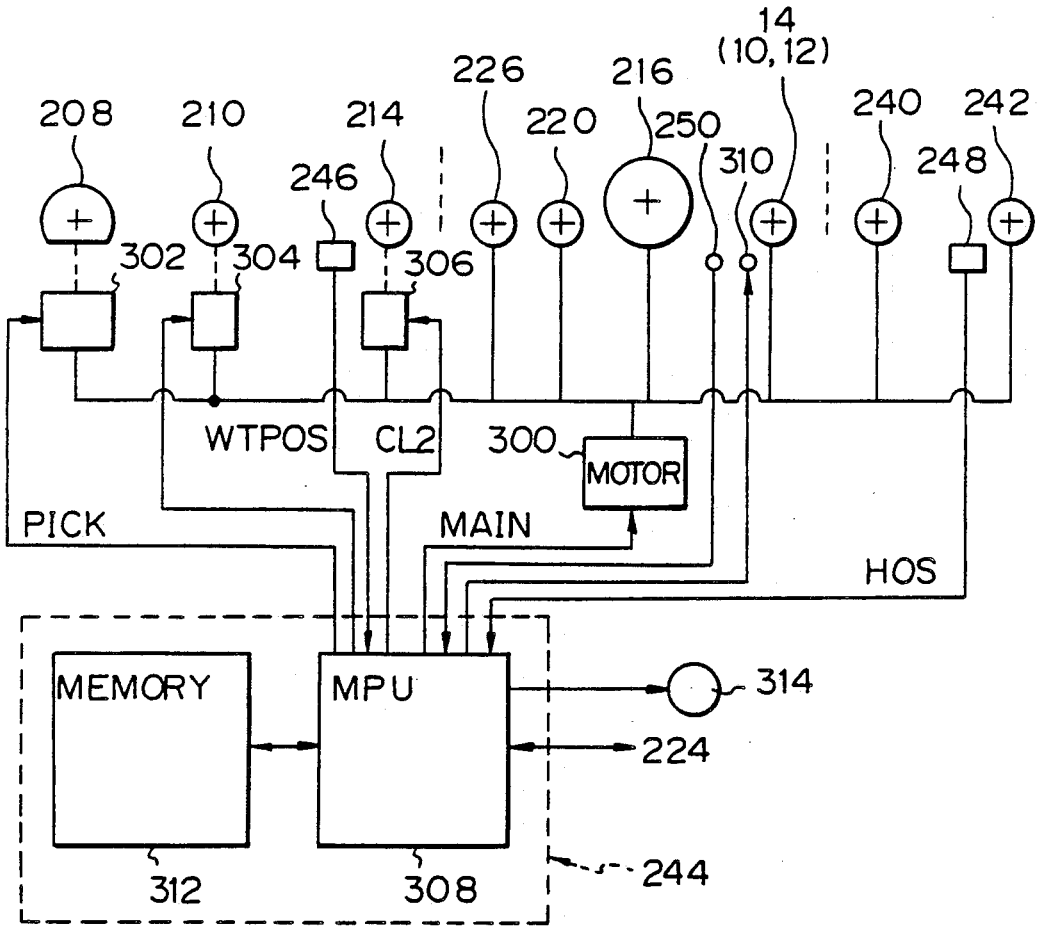
FIG. 3 is a block diagram illustrating a control system for a laser printer.

A control system for the laser printer 200 is illustrated in FIG. 3.

All of the rotating elements in the printer 200 are driven by a single main motor 300 through the respective transmission systems shown by solid lines.

The rollers 208, 210, and 214 are driven via clutches 302, 304, and 306, respectively, and these clutches can be switched on or off so that the roller 208, 210, and 214 can be operated regardless of the operation of the elements related to the image-forming process, such as the photoconductive drum 216, developer unit 226, or cleaner 220 (hereinafter referred to as "process elements").

The operations of the main motor 300 and the clutches 302, 304, and 306 are controlling by a microprocessor unit 308 (hereinafter referred to as "MPU").

The MPU 308 can forecast whether a life span of each of the process elements has expired by calculating a total number of rotations of the photoconductive drum 216 from the detected number of rotations of the main motor 300, and comparing the same with the respective set values determined for the above respective process elements.

In addition, outputs of the sensors 246, 248, and 250 are fed to the MPU 308, and the energization of a halogen lamp 310 used as a built-in heater of the heat roller 10 is controlled thereby.

The MPU 308 also controls the photo-unit 224 and a mirror motor 314 for the traverse scanning of the laser beam over the photoconductive drum 216. A memory 312 for this purpose is accommodated in the control unit 244.

A main switch (not shown) is provided for supplying an electric current to the printer 200. If the main switch is ON, the MPU 308 and a part operable with a low voltage, such as the memory 312 or a panel for the operator (not shown), are energized. The printer 200 also has an interlock switch (not shown) which is made ON or OFF in accordance with a shutting or opening of a front cover of the printer 200. When the front cover is shut, the interlock switch is closed and the main switch is ON, and thus a part operable with a high voltage, such as the precharger 222 or the halogen lamp 310, is also energized. Conversely, when the front cover is open, the supply of the current to the high voltage part is stopped, to avoid the risk of an electric shock.

The MPU 308 is programmed to start the initialization of the printer 200 when the main switch is ON and the interlock switch is switched from OFF to ON.

Figure 4:
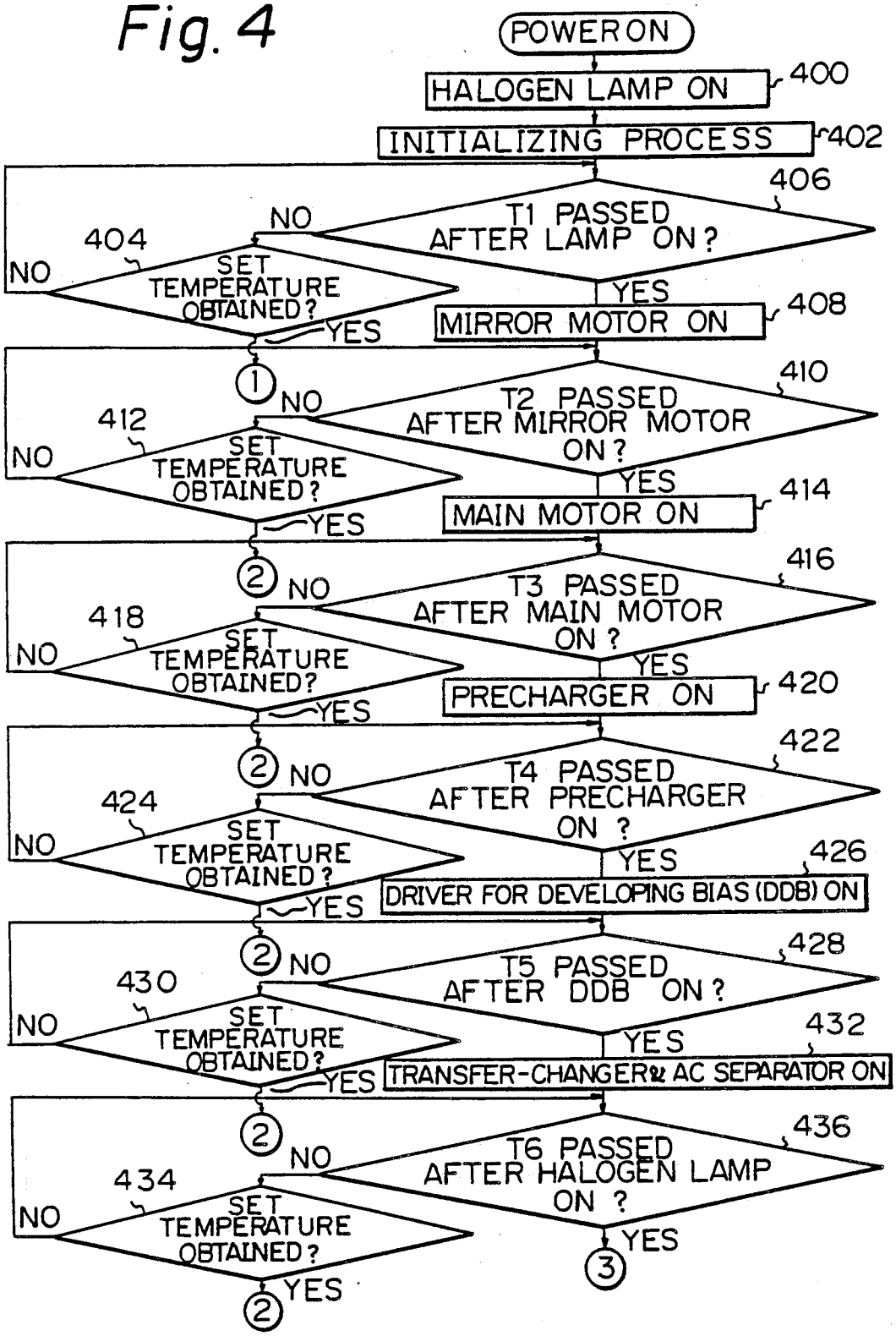
Figure 6:
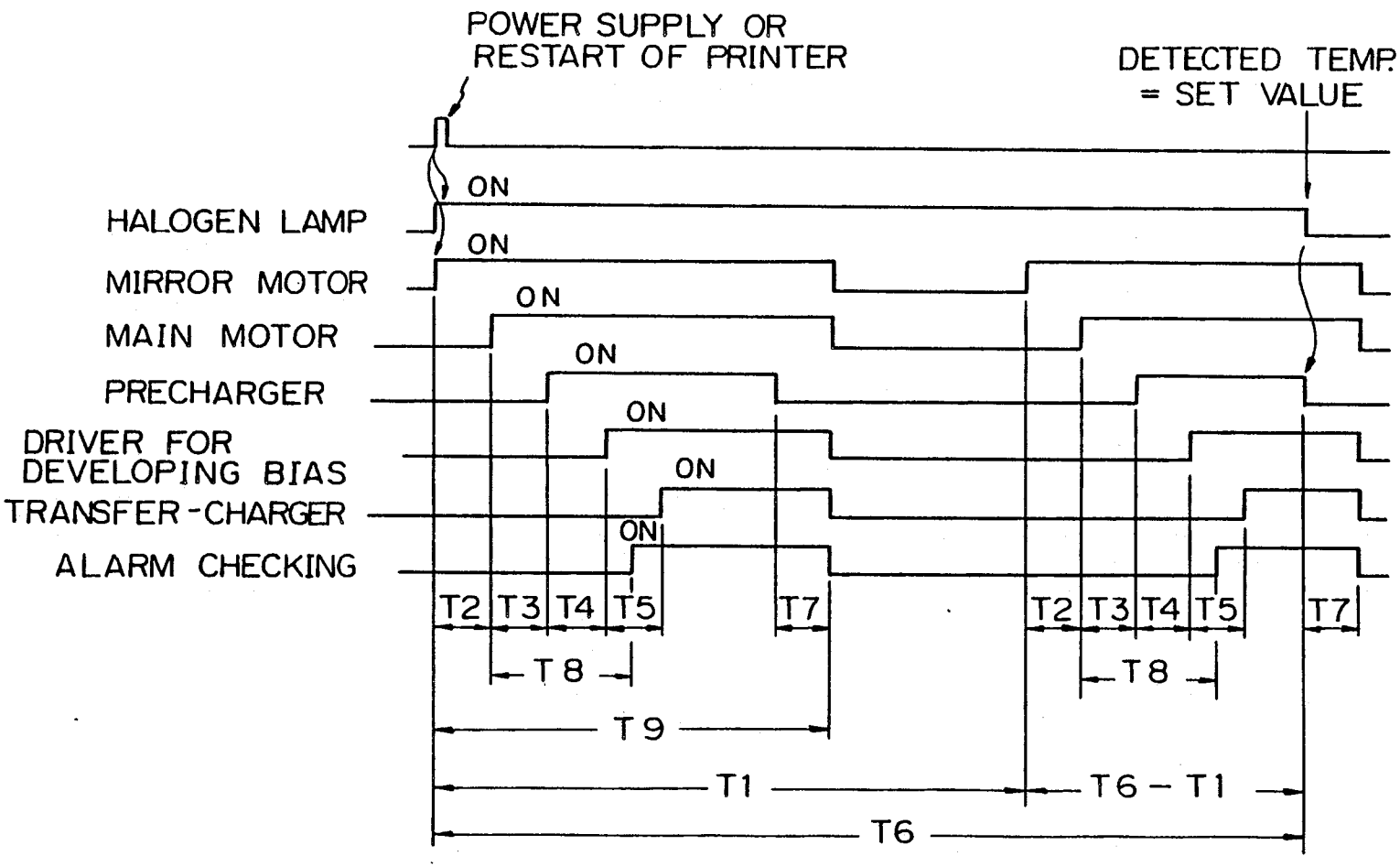
FIG. 6 is a time chart for explaining an operation of an embodiment of the present invention.

FIGS. 4 and 5 illustrate a flow chart of an example of the present invention, and FIG. 6 illustrates a time chart thereof.

When the main switch is closed to supply a current to the printer 200, or when the front cover is shut after a temporary machine stop to close the interlock switch, the energization of the halogen lamp 310 is started (step 400) to heat the heat roller 10. Then, as shown in FIG. 6, the initialization steps are carried out sequentially as follows: drive mirror motor 314; drive main motor 300; start operation of precharger 222; apply developing bias; start operation of transfercharger 238; and, check alarm means (step 402). In the above steps, the main motor 300 is started a period T2 after the halogen lamp 310 and the mirror motor 314 are started, to avoid a doubling of an initial peak current, and is driven for a period T9 (for example, 17 seconds), whereby the heat roller 10 and the backup roller 12 are rotated for a period T9 −T2. Similarly, a developing roller 230 in the developer 226 and the cleaner 220 are also rotated for a period (T9 −T2). The MPU 308 counts the number of rotations of the rollers.

The temperature is detected by the sensor 250 during the initialization process (402), and if the surface temperature of the heat roller 10 has reached the set value (190° C) within the period T9, the flow jumps to step 500 shown in FIG. 5, immediately after stopping the heat roller 10, and the halogen lamp 310 is switched OFF and the printer 200 is ready to commence the printing operation, provided that the other elements of the printer 200 have been reset to receive a start signal from the control unit 244.

Figure 8:
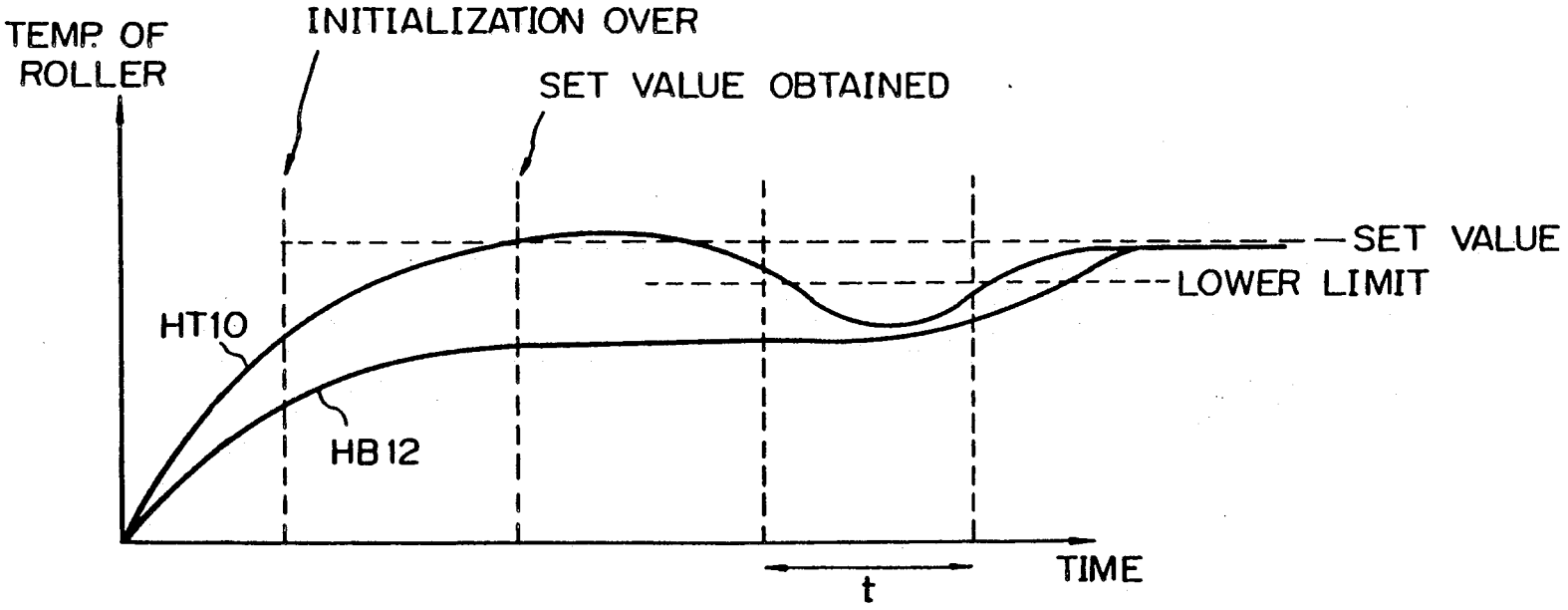
Fig. 8 PRIOR ART
FIG. 8 is a graph illustrating a temperature transition of the heat roller and the backup roller according to the prior art.
Figure 9:
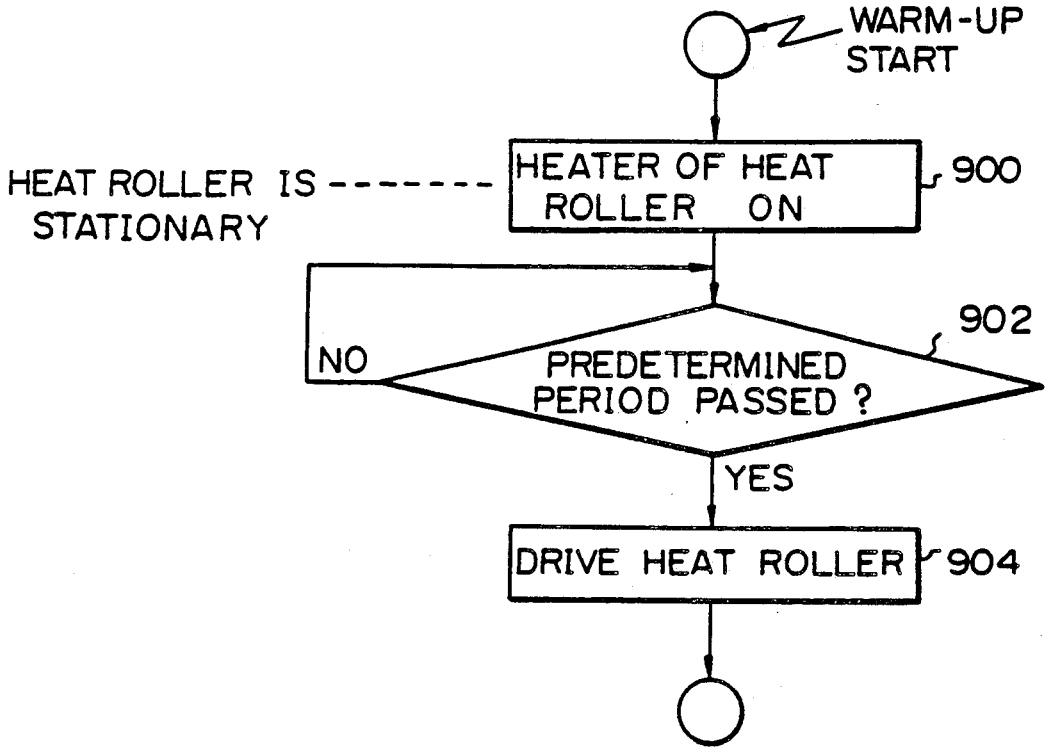
Fig. 9 PRIOR ART
FIG. 9 is a flow chart for explaining the control steps for a fuser unit according to the prior art.

After the completion of the initialization process (step 402), the MPU 308 determines whether a predetermined period T1 (for example, 60 seconds) has passed after the energization of the halogen lamp 310. If negative, the MPU 308 further determines whether the surface temperature of the heat roller 10 has reached the above set value (step 404). If positive, the flow jumps to step 500 and the printer 200 is made ready for printing (step 502). Namely, if the surface temperature of the heat roller 10 has reached the set value within the predetermined period T1 after the energization of the halogen lamp, the MPU 308 determines that the printer 200 is ready for a printing operations without additional warming-up steps, because it is surmised that the printer 200 as a whole is warm enough that an abnormal temperature drop soon after the commencement of printing, as shown in FIG. 8, will not occur. This occurs, for example, when the printer 200 is kept in a normal ambient room temperature before supplying electric current or when the printer 200 is restarted after a temporary machine stop.

Conversely, if the surface temperature of the heat roller 10 has not reached the set value within the above predetermined period T1, the initialization process is restarted as an additional warming-up process (steps 408, 414, 420, 426, 432). Namely, after the mirror motor 314 is driven, the main motor 300 is driven so that the heat roller 10 and the back-up roller 12 are again rotated. The respective warming-up steps are sequentially carried out for a predetermined period T2, T3, T4, T5 or T6, respectively, defined in the time chart illustrated in FIG. 4. During the respective step 408, 412, 420, 426, 432, the MPU 308 monitors the time elapsing and determines whether the predetermined period has expired (steps 410, 416, 422, 428, 436). If positive, the next step 414, 420, 426, or 432 is begun. If negative, then the MPU 308 determines whether the surface temperature of the heat roller 10 has reached the set value (steps 412, 418, 424, 430). If positive in any one of the steps 412, 418, 424, 430, the flow jumps to step 504 in FIG. 5(B), as illustrated in FIG. 4, and the halogen lamp 310 is switched OFF (step 04), the precharger is switched OFF (step 506), and after expiration of a predetermined period T7 (step 508), the main motor 300 is switched OFF (step 510), and accordingly, the printer 200 is ready to commence a printing operation (step 512).

Namely, if the surface temperature of the heat roller 10 has not reached the set value within the predetermined period T1 after the energization of the halogen lamp 310, the MPU 308 determines that an additional warming-up process is necessary, because it is concluded that the printer 200 has remained in a low ambient temperature condition for a long time and an abnormal temperature drop may occur soon after the commencement of printing as shown in FIG. 8.

If the surface temperature of the heat roller 10 has not reached the set value even after the expiration of a predetermined period T6 (for example, 90 seconds) after the energization of the halogen lamp 310, i.e., when positive in step 436, the MPU 308 determines that the fuser unit 14 has malfunctioned (step 514 in FIG. 5(C)) and, steps the energization of the halogen lamp 310 (step 516).

As stated above, according to the present invention, if the heat roller 10 is sufficiently heated during the first initialization process, the printer can start the printing operation without additional warming-up steps. But even when the additional warming-up process is needed, this process can be interrupted immediately after the set temperature has been reached so that the mechanical and electrostatic stresses imposed on the process elements are minimized. This also reduces the warming-up time and prolongs the life span of the process elements and the halogen lamp. Further the efficiency of the printer 200 is improved because a time needed to complete the machine warm-up is shortened.

Figure 7A:
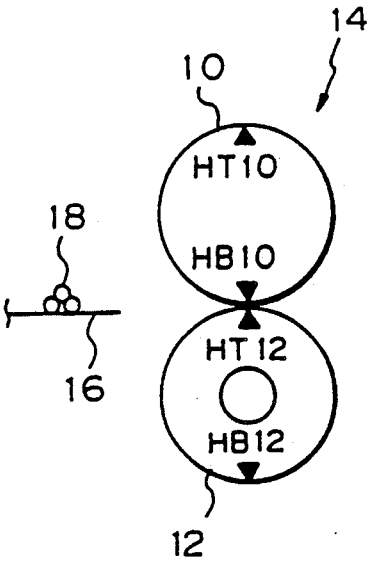
FIG. 7(A) and 7(B), respectively, are a diagrammatic side view of a fuser unit, illustrating a fixing of a toner onto a sheet medium.
Figure 7B:
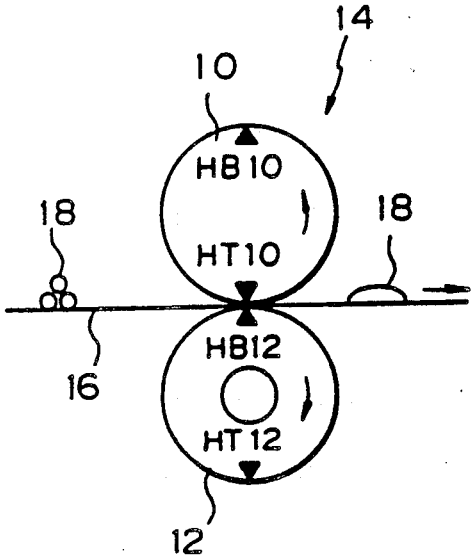

In this connection, the present inventors confirmed by experiment that, when the set temperature has not been reached at the heat roller 10 during the first initialization process, the temperature distribution at the heat roller 10 and the backup roller 12 can be greatly improved by displacing the position of both rollers from that shown in FIG. 7(A) to that shown in FIG. 7(B), by a half rotation of the rollers 10 and 12.

We claim:

1. A method of controlling a fuser unit of an image-forming apparatus including a heat roller having a heater and backup roller, wherein a sheet medium is nipped between the heat roller and the backup roller so that a toner image carried on the sheet medium is fixed, comprising the steps of:

(a) starting the energization of substantially at the same time as commencement of an initialization process of mechanical and electrostatic conditions of the apparatus while rotating the heat roller and the backup roller;

(b) stopping the rotation of the rollers after the initialization process has been completed;

(c) monitoring a surface temperature of the heat roller for a first predetermined period after completion of the initialization process, while keeping the heat roller and the backup roller stationary;

(d) determining that the fuser unit is ready for operation when the surface temperature has reached a set value within the first predetermined perion; and (e) restarting rotation fo the heat roller and the backup roller until the set value is reached, when the set value is not reached within the first predetermined period and unless a second predetermined period has expired subsequent to expiration of the first predetermined period.

2. A method of controlling a fuser unit of an image-forming apparatus including a main motor that drives substantially all rotating elements, the fuser unit comprises a heat roller having a heater and a back-up roller, wherein is nipped between the heat roller and the backup roller so that a toner image carried on the sheet medium is fixed, comprising the steps of:

(a) starting the energization of the heater substantially at the same time as commencement of an initialization process of the apparatus while rotating the heat roller and the backup roller;

(b) stopping the rotation of the rollers after the initialization process has been completed;

(c) monitoring a surface temperature of the heat roller for a first predetermined period after completion of the initialization process, while keeping the heat roller and the backup roller stationary;

(d) determining that the fuser unit is ready for operation when the surface temperature has reached a set value within the first predetermined period; and (e) restarting rotation of the heat roller and the backup roller until the set value is reached, when the set value is not reached within the first predetermined period and has expired subsequent to expiration of the first predetermined period.

3. A method as defined in claim 1, wherein the initialization process comprises the sub-steps of:

energizing the heater, the heater including a halogen lamp;

driving a mirror motor;

driving a main motor, the main motor driving the heat roller and the backup roller;

energizing a precharger;

imparting a developing bias; and energizing a transfer-charger;

4. A method as defined in claim 1, wherein step (a) includes the sub-step of:

energizing a halogen lamp.

5. A method as defined in claim 1, wherein step (e) includes the sub-step of:

repeating at least part of the initialization process.

6. A method as defined in claim 2, wherein the initialization process comprises the sub-steps of:

energizing the heater by providing current to a halogen lamp;

driving a mirror motor;

driving the main motor;

energizing a precharger;

imparting a developing bias; and energizing a transfer-charger;

7. A method as defined in claim 2, wherein step (a) includes the sub-step of:

energizing a halogen lamp.

8. A method as defined in claim 2, wherein step (e) includes the sub-step of:

repeating at least part of the initialization process.

9. A method as defined in claim 1, wherein step (e) includes the sub-step of:

stopping the rotation of the rollers after the rollers have been rotated about 180°.

10. A method as defined in claim 2, wherein step (e) includes the sub-step of:

stopping the rotation of the rollers after the rollers have been rotated about 180°.

11. A method of controlling a fuser unit including a heat roller, a heater for heating the heat roller, and a backup roller, comprising the steps of:

(a) energizing the heater while rotating the heat roller and the backup roller;

(b) stopping the rotation of the heat roller and the backup roller;

(c) monitoring a temperature of at least one of the heat roller and the backup roller for a first predetermined period after step (b) while keeping the heat roller and the backup roller stationary;

(d) determining that the fuser unit is ready for operation when the temperature monitored in step (c) reaches a set value within said first predetermined period;

(e) restarting rotation of the heat roller and the backup roller when said set value is not reached within said first predetermined period;

(f) monitoring the temperature of at least one of the heat roller and the backup roller for a second predetermined period, said second predetermined period being subsequent to expiration of said first predetermined period;

(g) determining that the fuser unit is ready for operation when the temperature monitored in step (f) reaches said set value within said second predetermined period; and (h) restopping rotation of the heat roller and the backup roller when said set value is not reached within said second predetermined period, said second predetermined period expiring subsequent to expiration of said first predetermined period.

12. A method of controlling a fuser unit including a heat roller, a heater for heating the heat roller, and a backup roller, comprising the steps of:

(a) energizing the heater while rotating the heat roller and the backup roller;

(b) stopping the rotation of the heat roller and the backup roller;

(c) monitoring a temperature of at least one of the heat roller and the backup roller for a first predetermined period after completion of step (b) while keeping the heat roller and the backup roller stationary;

(d) determining that the fuser unit is ready for operation when the temperature monitored in step (c) reaches a set value within said first predetermined period; and (e) rotating the heat roller and the backup roller about 180° when said set value is not reached within said first predetermined period.

* * * * *

UNITED STATES PATENT AND TRADEMARK OFFICE

CERTIFICATE OF CORRECTION

PATENT NO. : 4,996,567

DATED : February 26, 1991

INVENTOR(S) : SHINICHI WATARAI et al.

It is certified that error appears in the above-identified patent and that said Letters Patent is hereby corrected as shown below:

Title Page, under "U.S. Patent Documents", line 3, change "1985" to --1984--.

Front page, under "Foreign Patent Documents" insert

--DE-A-3114013 11/19/81 DE

DE-A-3224239 01/13/83 DE

DE-A-3532739 03/27/86 DE--.

Col. 1, line 51, change "abovementioned" to --above-mentioned--.

Col. 6, line 42, change "04" to --504--; and

Col. 6, line 62, change ",steps" to --stops--.

Col. 7, line 24, after "of" insert --the heater--;

Col. 7, line 37, change "perion" to --period--;

Col. 7, line 38, change "fo" to --of--;

Col. 7, line 48, after "wherein" insert --a sheet medium--; and

UNITED STATES PATENT AND TRADEMARK OFFICE

CERTIFICATE OF CORRECTION

PATENT NO. : 4,996,567

DATED : February 26, 1991

INVENTOR(S) : Shinichi Watarai et al

It is certified that error appears in the above-identified patent and that said Letters Patent is hereby corrected as shown below:

Col. 7, line 67, after "and" insert --unless a second predetermined period--.

Signed and Sealed this

Eleventh Day of August, 1992

*Attest:*

DOUGLAS B. COMER

*Attesting Officer*

*Acting Commissioner of Patents and Trademarks*